US012616346B2

(12) United States Patent
Ding et al.

(10) Patent No.: US 12,616,346 B2
(45) Date of Patent: May 5, 2026

(54) ROBOTIC CLEANER

(71) Applicant: SHARKNINJA OPERATING LLC, Needham, MA (US)

(72) Inventors: Jun Feng Ding, Shenzhen (CN); Evan P. Jasper, Whitman, MA (US); Yi hui Zhang, Shenzhen (CN); Hamish Thompson, London (GB); Max Davidowitz, Needham, MA (US); Simon Hughes, London (GB); Jianjun Ge, Shenzhen (CN); Jian Xiang, Guangdong (CN)

(73) Assignee: SharkNinja Operating LLC, Needham, MA (US)

( * ) Notice: Subject to any disclaimer, the term of this patent is extended or adjusted under 35 U.S.C. 154(b) by 771 days.

(21) Appl. No.: 17/889,734

(22) Filed: Aug. 17, 2022

(65) Prior Publication Data

US 2024/0016356 A1 Jan. 18, 2024

Related U.S. Application Data

(63) Continuation of application No. PCT/CN2022/105617, filed on Jul. 14, 2022.

(51) Int. Cl.
*A47L 11/282* (2006.01)
*A47L 11/40* (2006.01)

(52) U.S. Cl.
CPC ..... *A47L 11/282* (2013.01); *A47L 11/4083* (2013.01); *A47L 2201/00* (2013.01)

(58) Field of Classification Search
CPC .. A47L 11/282; A47L 11/408; A47L 11/4083; A47L 2201/00
See application file for complete search history.

(56) References Cited

U.S. PATENT DOCUMENTS

| | | | |
|---|---|---|---|
| 8,887,347 | B2 | 11/2014 | Louis et al. |
| 9,320,402 | B2 | 4/2016 | Krondorfer et al. |
| 2013/0058635 | A1 | 3/2013 | Vrdoljak |
| 2013/0152337 | A1 | 6/2013 | Thorne |

(Continued)

FOREIGN PATENT DOCUMENTS

| | | |
|---|---|---|
| CN | 207785068 | 8/2018 |
| CN | 108634881 | 10/2018 |

(Continued)

OTHER PUBLICATIONS

CN111685653A (machine translation) (Year: 2020).*

(Continued)

*Primary Examiner* — Andrew A Horton
(74) *Attorney, Agent, or Firm* — Secant IP

(57) ABSTRACT

A robotic cleaner may include one or more driven wheels, at least one environmental sensor, and a mop module. The mop module may include a tank having a tank inlet and a tank outlet, a pad coupled at a bottom side of the tank, the pad configured to contact a surface to be cleaned and to receive liquid from the tank outlet, and a latch configured to transition between a latched position, a release position, and a refill position. When in the latched position and in the release position, at least a portion of the latch may extend over the tank inlet and, when in the refill position, the latch may be displaced from the tank inlet, exposing the tank inlet.

19 Claims, 11 Drawing Sheets

(56) References Cited

U.S. PATENT DOCUMENTS

2014/0150201 A1 6/2014 McGee et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne
2016/0128530 A1 5/2016 Thorne et al.
2016/0150934 A1* 6/2016 Kim ..... A47L 11/4036 15/300.1
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046184 A1 2/2020 Freese et al.
2020/0060496 A1 2/2020 Dawson et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0204684 A1 7/2021 Heman-Ackah et al.
2021/0254615 A1 8/2021 Vrdoljak et al.
2021/0307581 A1 10/2021 Thorne et al.
2021/0315428 A1 10/2021 Udy et al.
2021/0330159 A1 10/2021 Rukavina
2021/0386261 A1 12/2021 Woodrow et al.
2021/0386262 A1 12/2021 Uchendu et al.
2022/0031131 A1 2/2022 McClay et al.
2022/0031133 A1 2/2022 Der Marderosian et al.
2022/0031134 A1 2/2022 Yang et al.
2022/0061614 A1 3/2022 Yu et al.
2022/0071459 A1 3/2022 Gacin et al.
2022/0095864 A1 3/2022 Der Marderosian et al.
2022/0125256 A1 4/2022 Lessard et al.
2022/0287521 A1 9/2022 Cottrell et al.
2022/0322903 A1 10/2022 Lessard
2022/0400922 A1 12/2022 McClay et al.
2022/0408994 A1 12/2022 Hill
2023/0043567 A1 2/2023 Copeland et al.
2023/0070147 A1 3/2023 Harting et al.
2023/0157495 A1 5/2023 Copeland et al.
2023/0248192 A1 8/2023 Brown et al.
2023/0320550 A1 10/2023 Teuscher et al.
2023/0329502 A1 10/2023 Chirikjian
2023/0355065 A1 11/2023 Finnegan
2023/0414052 A1 12/2023 McClay et al.
2024/0008699 A1 1/2024 Innes et al.
2024/0415352 A1 12/2024 McClay et al.

FOREIGN PATENT DOCUMENTS

CN 210749039 6/2020
CN 111685653 9/2020
CN 214712383 11/2021
CN 214906439 11/2021
CN 114052574 2/2022
WO 2021020680 2/2021

OTHER PUBLICATIONS

PCT Search Report and Written Opinion mailed Dec. 29, 2022, received in corresponding PCT Application No. PCT/CN22/105617, 10 pages.

* cited by examiner

ROBOTIC CLEANER

TECHNICAL FIELD

The present disclosure is generally related to robotic cleaners and more specifically related to components that are removably coupled to a robotic cleaner.

BACKGROUND INFORMATION

Robotic cleaners are configured to autonomously clean a surface (e.g., a floor). An example robotic cleaner is configured to carry out one or more cleaning behaviors while traversing the surface. The cleaning behaviors may include one or more of a wet cleaning behavior and/or a dry cleaning behavior. For example, the robotic cleaner may include a mop module (for a wet cleaning behavior) and a suction motor and dust cup (for a dry cleaning behavior). In this example, the mop module may be removably coupled to the robotic cleaner (e.g., such that the robotic cleaner may carry out a dry cleaning only behavior and/or for refilling of the mopping module).

BRIEF DESCRIPTION OF THE DRAWINGS

These and other features and advantages will be better understood by reading the following detailed description, taken together with the drawings, wherein.

DETAILED DESCRIPTION

The present disclosure is generally related to a mop module for a robotic cleaner. The mop module includes a tank configured to hold a liquid (e.g., water), a pad configured to contact a surface to be cleaned (e.g., a floor), and a latch configured to removably couple the mop module to the robotic cleaner. The tank defines at least one liquid inlet and at least one liquid outlet. Liquid is introduced to the tank through the liquid inlet. Liquid flowing through the liquid outlet is received by the pad. The latch is coupled to the tank proximate to the liquid inlet such that the latch extends over the liquid inlet when the mop module is coupled to the robotic cleaner.

Figure 1:
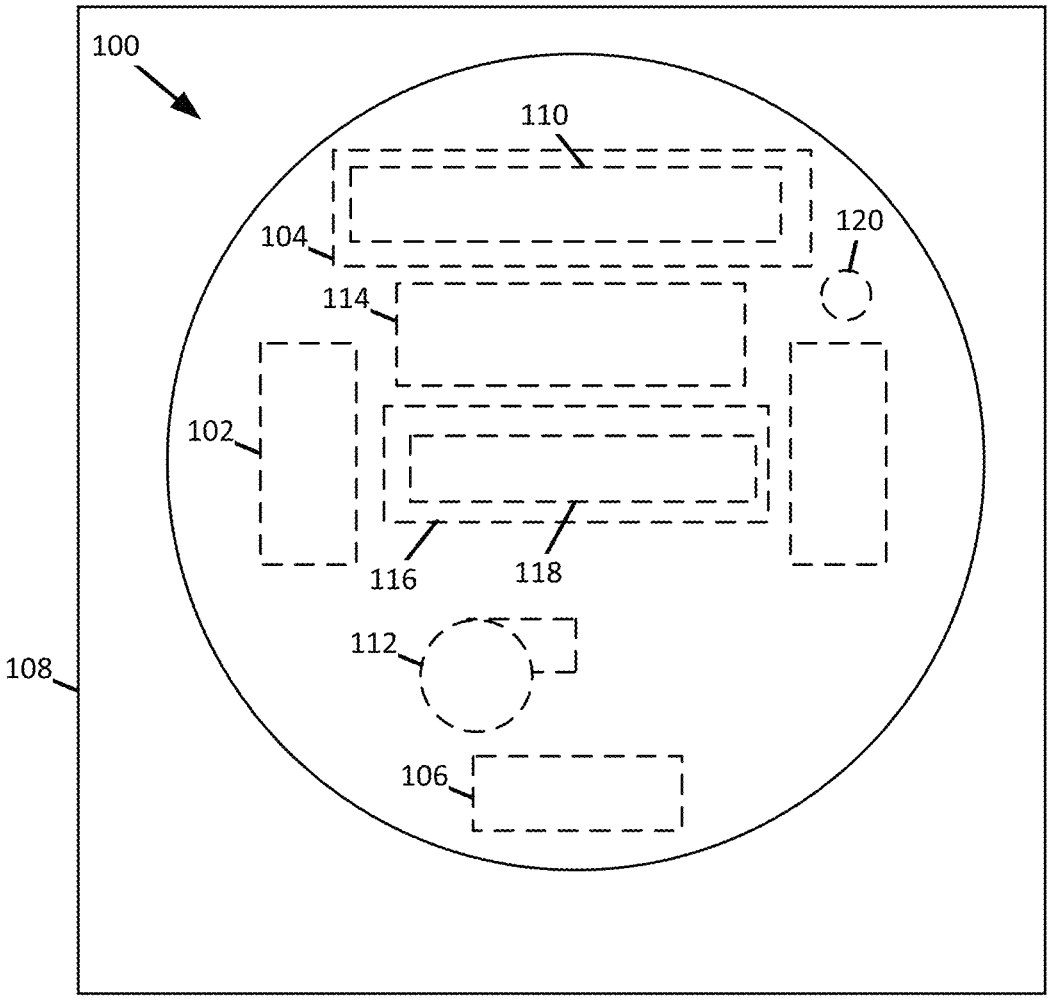
FIG. 1 shows a schematic example of a robotic cleaner, consistent with embodiments of the present disclosure.

FIG. 1 shows a schematic example of a robotic cleaner 100. As shown, the robotic cleaner 100 includes one or more driven wheels 102, a mop module 104, and one or more environmental sensors 106 (e.g., localization sensors, obstacle sensors, and/or any other sensor). The one or more driven wheels 102 are configured to urge the robotic cleaner 100 along a surface to be cleaned 108 (e.g., a floor). The mop module 104 includes a mop pad 110 configured to contact and slide along the surface to be cleaned 108 to collect debris. As further shown, the robotic cleaner may further include a suction motor 112 fluidly coupled to a dust cup 114 and an agitator chamber 116. An agitator 118 (e.g., a brush roll) may extend within the agitator chamber 116 and be configured to rotate along a rotation axis that extends substantially parallel to the surface to be cleaned 108.

The mop module 104 may be configured such that the mop pad 110 is agitated (e.g., rotated and/or linearly oscillated) as the robotic cleaner 100 traverses the surface to be cleaned 108. For example, the robotic cleaner 100 and/or the mop module 104 may include an agitation motor 120 configured to agitate the mop pad 110.

Figure 2:
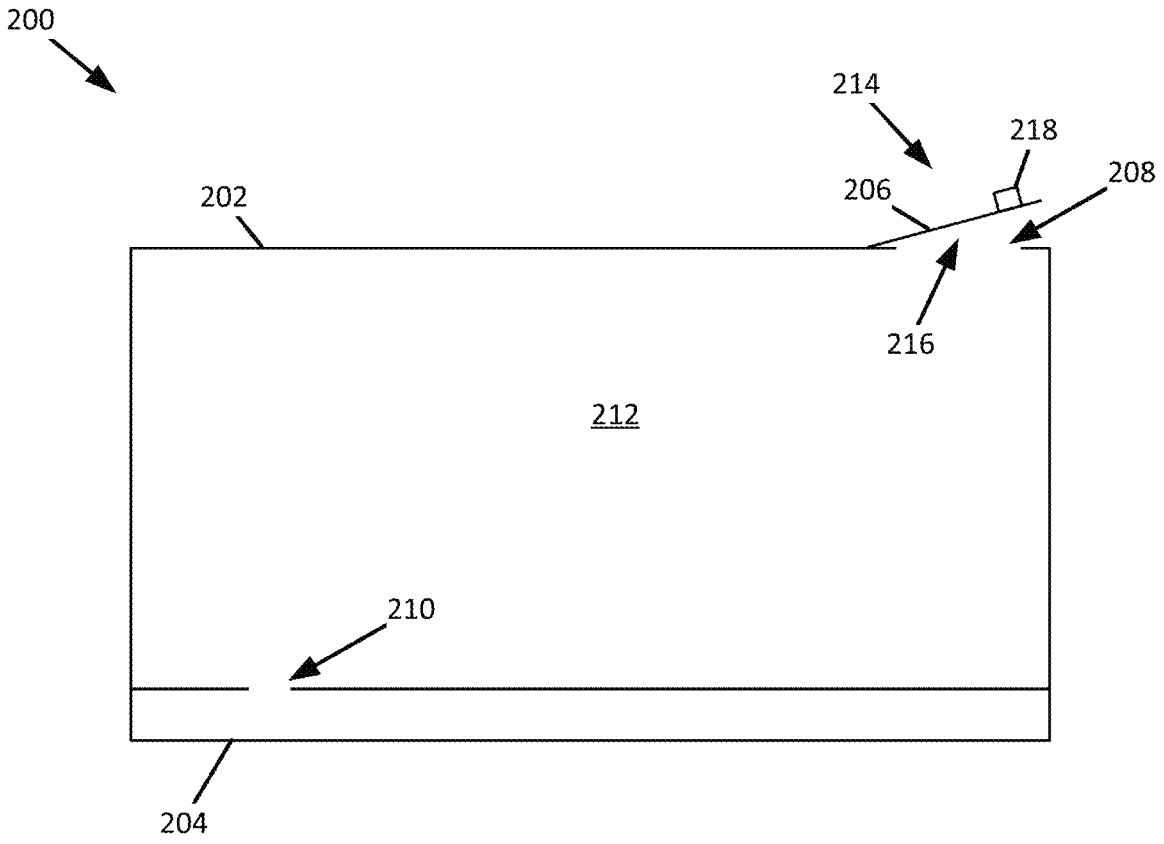
FIG. 2 shows a schematic example of a mop module, consistent with embodiments of the present disclosure.

FIG. 2 shows a schematic cross-sectional side view of a mop module 200, which may be an example of the mop module 104 of FIG. 1. The mop module 200 includes a tank 202 configured to hold a liquid (e.g., water), a pad 204 coupled to the tank 202 (e.g., at a bottom side of the tank 202), and a latch 206 configured to removably couple the tank 202 to the robotic cleaner 100 of FIG. 1.

The tank 202 includes at least one tank inlet 208, at least one tank outlet 210, and a liquid chamber 212. The tank inlet 208 and the tank outlet 210 can be positioned on opposing sides of the liquid chamber 212. Liquid passing through the liquid inlet 208 is received within the liquid chamber 212. Liquid received within the liquid chamber 212 passes through the tank outlet 210. Liquid passing through the tank outlet 210 is received by the pad 204. In some instances, the tank outlet 210 may be configured such that liquid selectively passes through the tank outlet 210. For example, the tank outlet 210 may be configured such that liquid only passes therethrough when the robotic cleaner 100 is engaging in a wet cleaning operation and/or periodically (e.g., when it is determined the pad 204 is not adequately moistened).

The latch 206 may generally be described as being a multi-function latch configured to removably couple the mop module 200 to the robotic cleaner 100 and to selectively cover the tank inlet 208. For example, the latch 206 may be configured to transition (e.g., in response to rotational movement) between a latched position, a release position, and a refill position. When the mop module 200 is coupled to the robotic cleaner 100 and the latch 206 is in the latched position, separation of the mop module 200 from the robotic cleaner 100 is prevented and at least a portion of the latch 206 extends over the tank inlet 208. When the mop module 200 is coupled to the robotic cleaner 100 and the latch 206 is in the release position, the mop module 200 may be separated from the robotic cleaner 100 and at least a portion of the latch 206 extends over the tank inlet 208. When the mop module 200 is separated from the robotic cleaner 100, the latch 206 can be rotated to the refill position. When the mop module 200 is coupled to the robotic cleaner 100 the latch 206 may be prevented from rotating to the refill position. When in the refill position, the latch 206 is displaced from the tank inlet 208 such that the tank inlet 208 is exposed, enabling a fluid to pass through the tank inlet 208. For example, when in the refill position, the latch 206 does not extend over the tank inlet 208.

The latch 206 can be coupled to the tank 202 (e.g., pivotally coupled). The latch 206 includes a latching side 214 and a closing side 216, the latching side 214 being opposite the closing side 216. The latching side 214 includes a catch 218 configured engage with a portion of the robotic cleaner 100 to removably couple the mop module 200 to the robotic cleaner 100. The closing side 216 is configured to selectively extend over the tank inlet 208.

Figure 3:
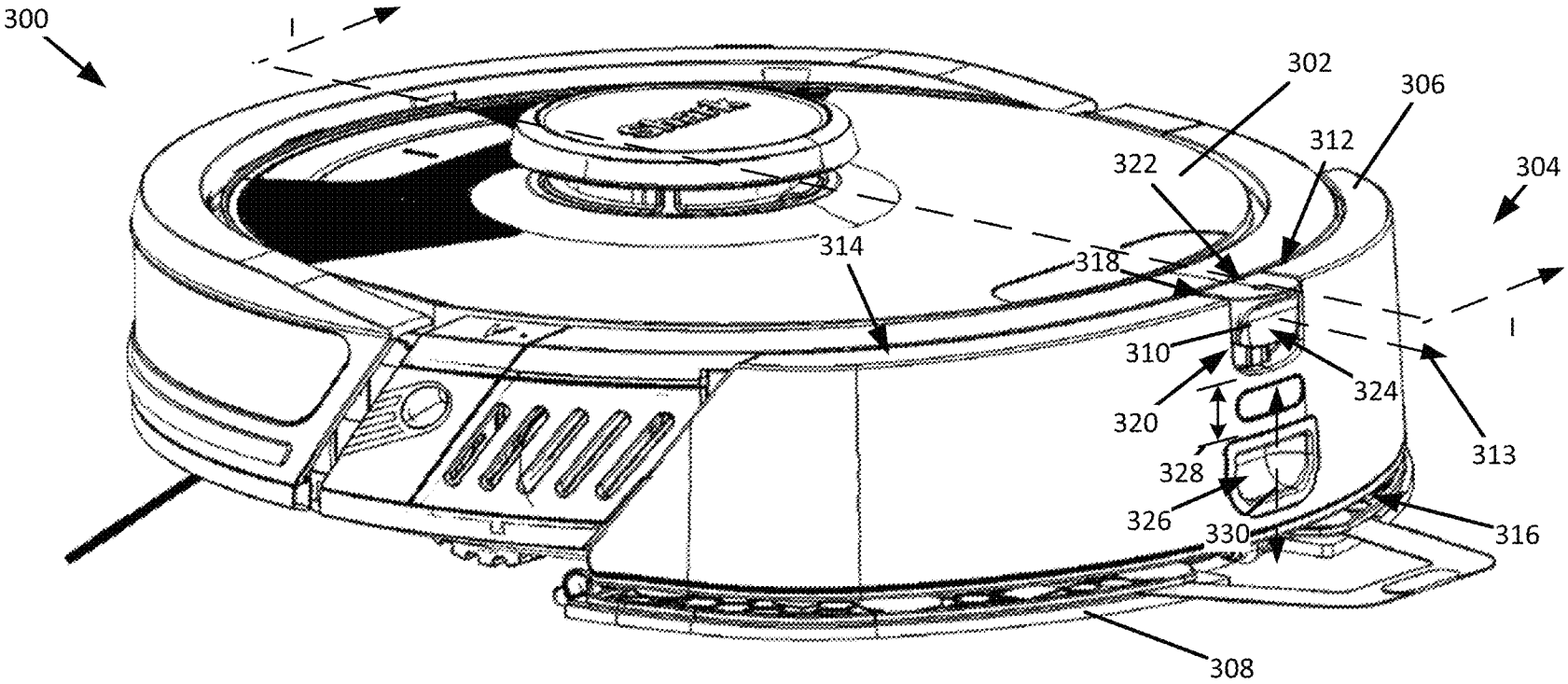
FIG. 3 shows a perspective rear view of a robotic cleaner, consistent with embodiments of the present disclosure.

FIG. 3 shows a rear perspective view of a robotic cleaner 300, which may be an example of the robotic cleaner 100 of FIG. 1. As shown, the robotic cleaner 300 includes a cleaner body 302 and a mop module 304 that is removably coupled to the robotic cleaner 300. The mop module 304 includes a tank 306 configured to receive a liquid (e.g., water) and a pad 308 configured to be wetted using liquid from the tank 306.

The mop module 304 further includes a latch 310 configured to removably couple the mop module 304 to the robotic cleaner 300. The latch 310 can be disposed within a receptacle 312 that is defined by the tank 306. The receptacle 312 may be positioned (e.g., centrally positioned) along a central axis 313 of the tank 306, wherein the central axis 313 extends substantially parallel to a forward direction of movement of the robotic cleaner 300. As shown, the receptacle 312 extends from an upper side 314 of the tank 306 towards a bottom side 316 of the tank 306, the pad 308 being coupled at the bottom side 316 of the tank 306. The receptacle 312 includes at least a first open side 318 and a second open side 320, the first open side 318 extending transverse to (e.g., perpendicular to) the second open side 320. As shown, the latch 310 includes a first user interaction surface 322 that extends along the first open side 318 and a second user interaction surface 324 that extends along the second open side 320.

The first user interaction surface 322 may be configured to receive a pressing force from a user. In response to receiving the pressing force, the latch 310 may be caused to transition from a latched position to a release position. When the latch 310 is in the release position, the user may remove the mop module 304 from the robotic cleaner 300. As shown, the tank 306 may further include a finger recess 326 that is configured to better facilitate the application of the pressing force by the user. For example, when the user applies the pressing force using a thumb, the finger recess 326 may receive a portion of another finger (e.g., an index finger). As shown, the finger recess 326 may be spaced apart from (e.g., vertically spaced apart from) the latch 310 by a recess separation distance 328. The recess separation distance 328 may be in a range of 1.5 centimeters (cm) to 3.5 cm. The finger recess 326 may be positioned such that a recess axis 330 intersects the latch 310. The recess axis 330 may be a central vertical axis of the finger recess 326.

The second user interaction surface 324 may be configured to receive a lifting force. For example, the second user interaction surface 324 may define a tab configured to be gripped by a user. The lifting force applied to the second user interaction surface 324 may cause the latch 310 transition to the refill position.

Figure 4:
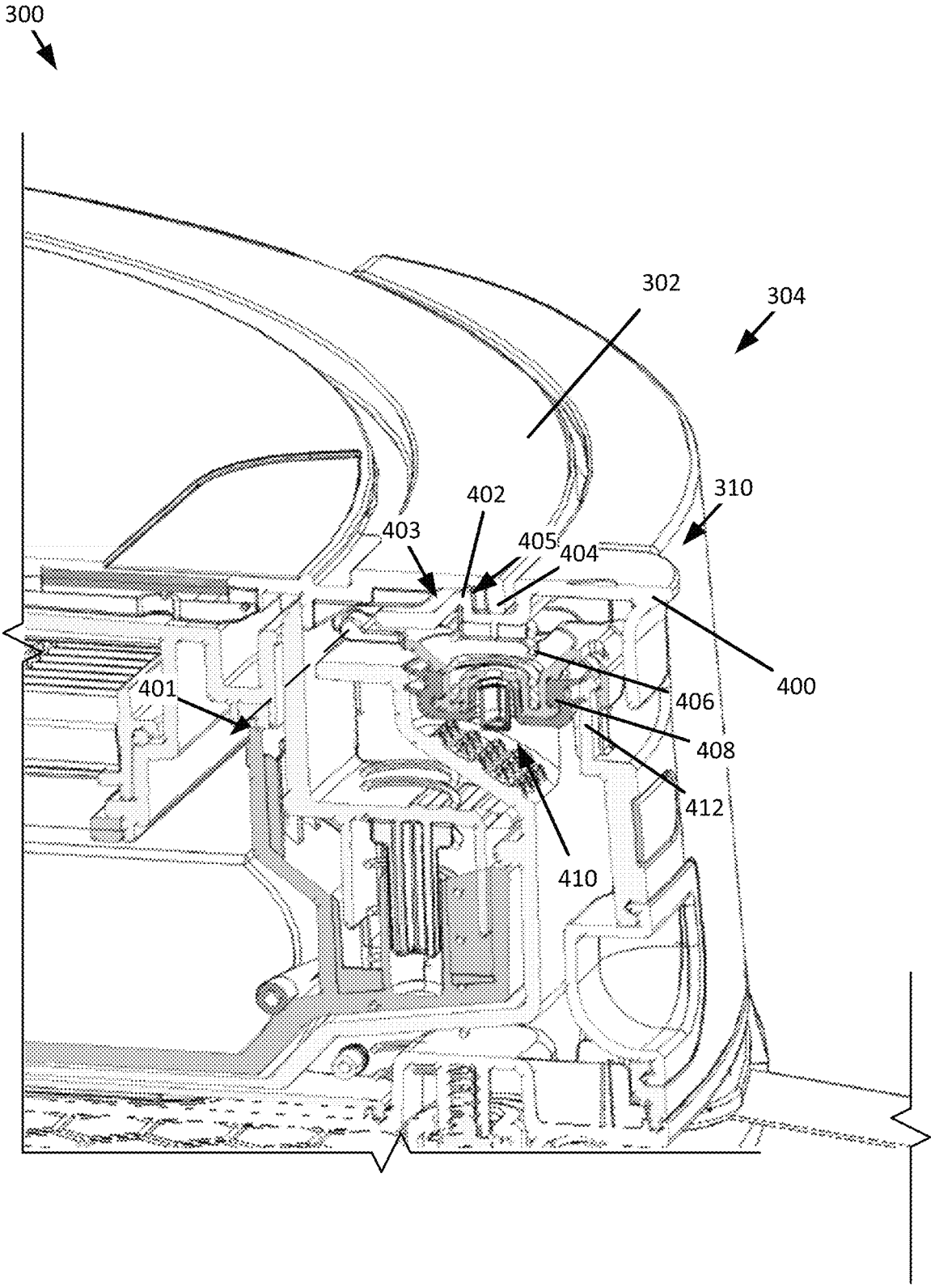
FIG. 4 shows a cross-sectional perspective view of the robotic cleaner of FIG. 3 taken along the line I-I having a latch in a latched position, consistent with embodiments of the present disclosure.
Figure 5:
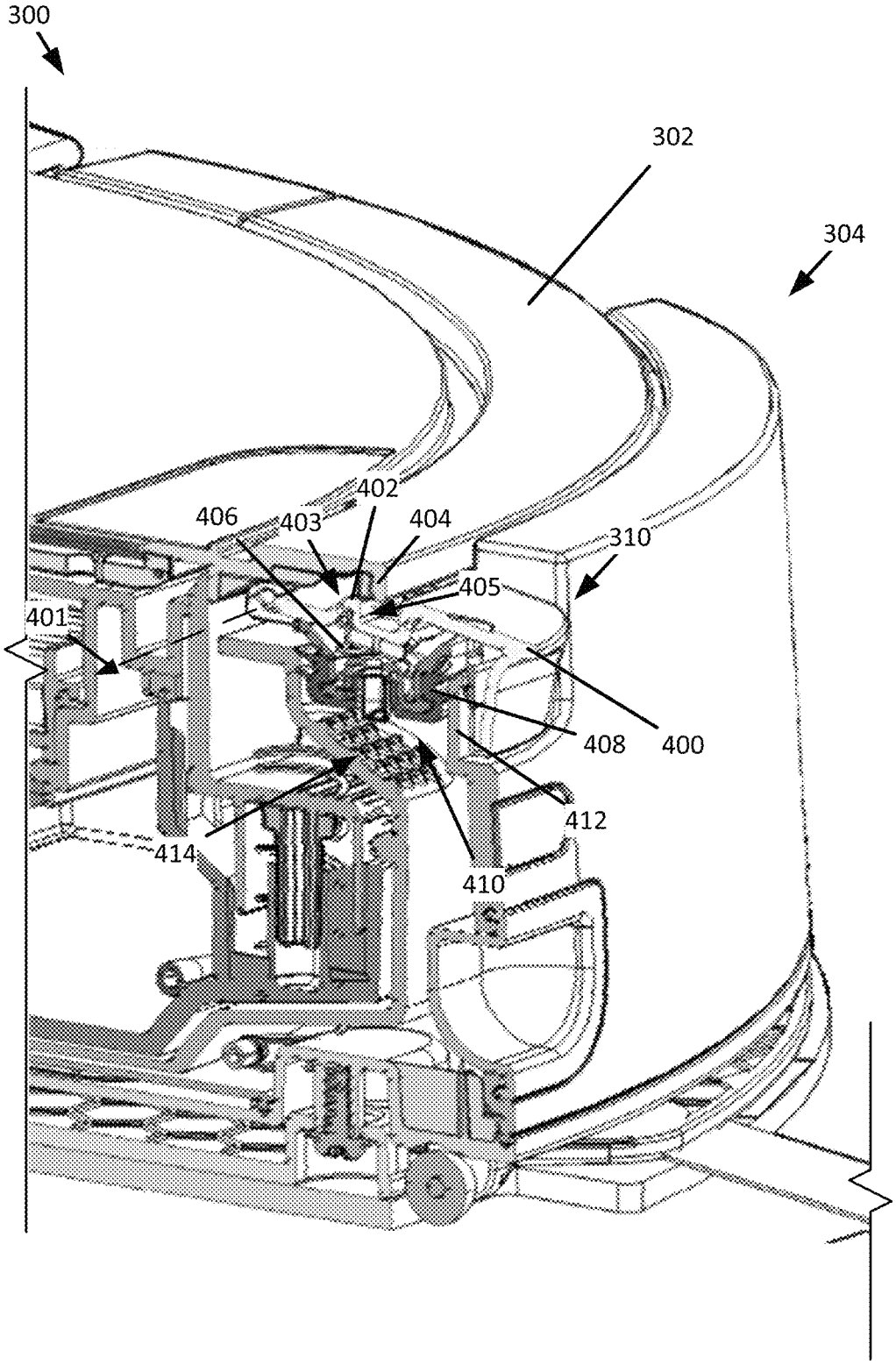
FIG. 5 shows a cross-sectional perspective view of the robotic cleaner of FIG. 3 taken along the line I-I having the latch in a release position, consistent with embodiments of the present disclosure.

FIG. 4 shows a cross-sectional perspective view of a portion of the robotic cleaner 300 taken along the line I-I of FIG. 3, wherein the latch 310 is in the latched position, and FIG. 5 shows a cross-sectional perspective view of a portion of the robotic cleaner 300 taken along the line I-I of FIG. 3, wherein the latch 310 is in the release position.

As shown, the latch 310 includes a lever body 400 pivotally coupled to the tank 306 such that the lever body 400 rotates about a rotation axis 401 in response to the latch 310 transitioning between the refill position, the latched position, and the release position. As shown, when the mop module 304 is coupled to the robotic cleaner 300, the latch 310 is in one of the latched position or the release position. In other words, the latch 310 may be prevented from transitioning to the refill position when the mop module 304 is coupled to the robotic cleaner 300. Such a configuration may prevent inadvertent spilling of liquid from the tank 306.

The lever body 400 includes (e.g., defines) a catch 402. When the mop module 304 is coupled to the robotic cleaner 300 and the latch 310 is in the latched position, the catch 402 is configured to engage a protrusion 404 extending from the cleaner body 302 of the robotic cleaner 300. When the latch 310 is in the release position, the catch 402 is vertically spaced apart from the protrusion 404 such that the protrusion 404 does not substantially interfere with the removal of the mop module 304. A biasing mechanism 406 urges the lever body 400 to rotate in a direction of the protrusion 404.

The catch 402 includes an insertion side 403 and a retention side 405. The insertion side 403 of the catch 402 may extend from the lever body 400 at a non-perpendicular angle. For example, the insertion side 403 may form an obtuse angle with the lever body 400, which may encourage easier coupling of the mop module 304 to the robotic cleaner 300. The retention side 405 may extend from the lever body 400 at a substantially perpendicular angle. For example, the retention side 405 may extend from lever body 400 such that retention side 405 is substantially parallel to the protrusion 404 when the latch 310 is in the latched position. The retention side 405 is configured to engage the protrusion 404 to prevent removal of the mop module 304 from the robotic cleaner 300 when the latch 310 is in the latched position.

As shown, the latch 310 includes a plug 408 configured to be received within a tank inlet 410 of the tank 306 (e.g., when the latch 310 is in the latched position and the release position). The plug 408 and the catch 402 can be on opposite sides of the lever body 400. When the latch 310 is transitioned to the refill position, the plug is removed from the tank inlet 410. The plug 408 may be configured to form an at least partial seal (e.g., an at least partially liquid tight seal) with an inlet sidewall 412 defining the tank inlet 410. The plug 408 and the catch 402 are positioned on opposite sides of the lever body 400. For example, the plug 408 can be positioned on a side of the lever body 400 that faces the tank 306 and the catch 402 can be positioned on a side of the lever body 400 that faces an upper surface of the cleaner body 302 (or that faces away from the pad 308).

As also shown, a textured surface 414 may extend below the tank inlet 410. The textured surface 414 may be positioned such at least a portion of a liquid passing through the tank inlet 410 is incident on the textured surface 414. The textured surface 414 may be configured to mitigate splashing of liquid incident on the textured surface 414.

Figure 6:
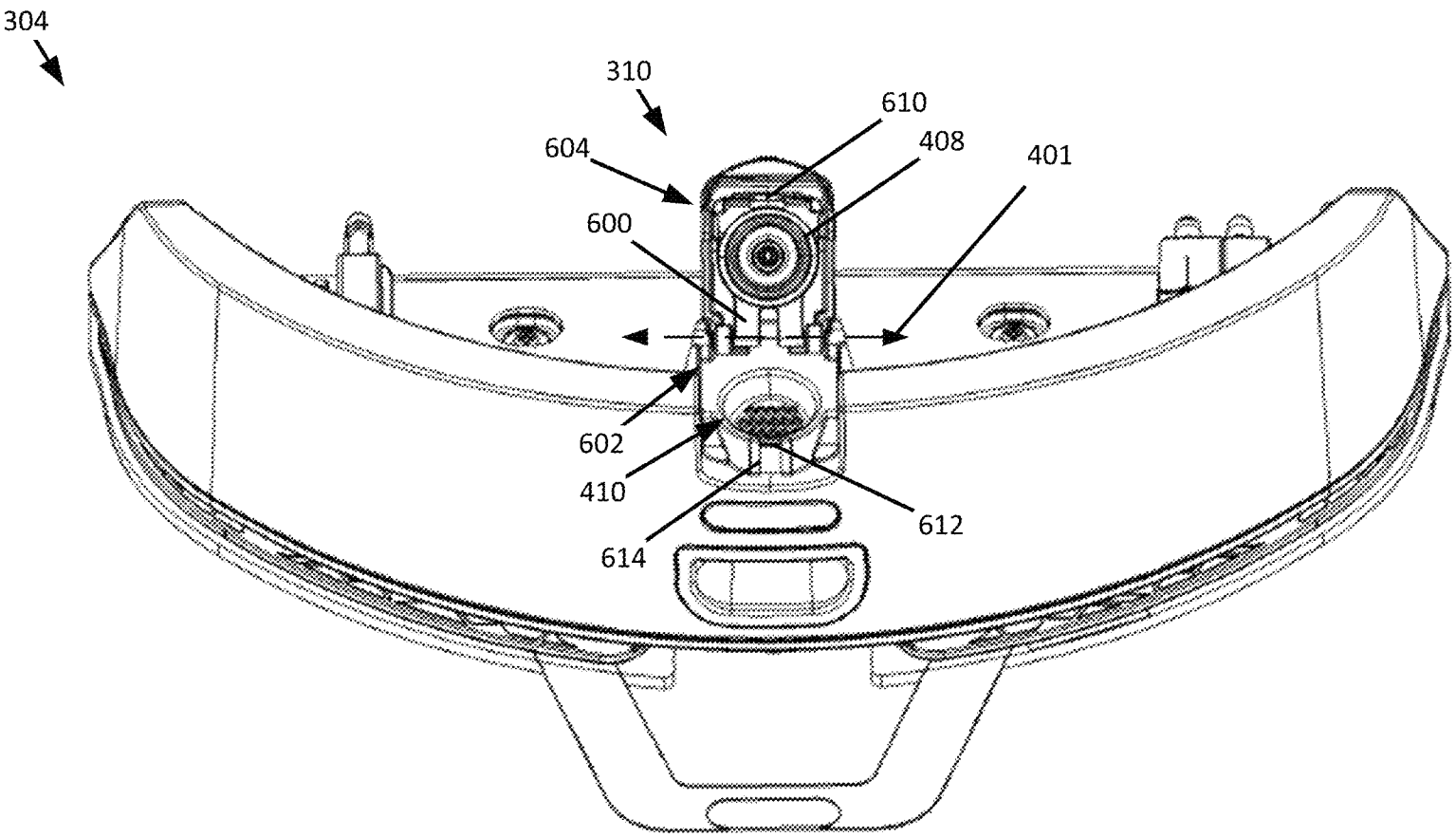
FIG. 6 shows a perspective rear-view of a mop module of the robotic cleaner of FIG. 3 having the latch in a refill position, consistent with embodiments of the present disclosure.
Figure 7:
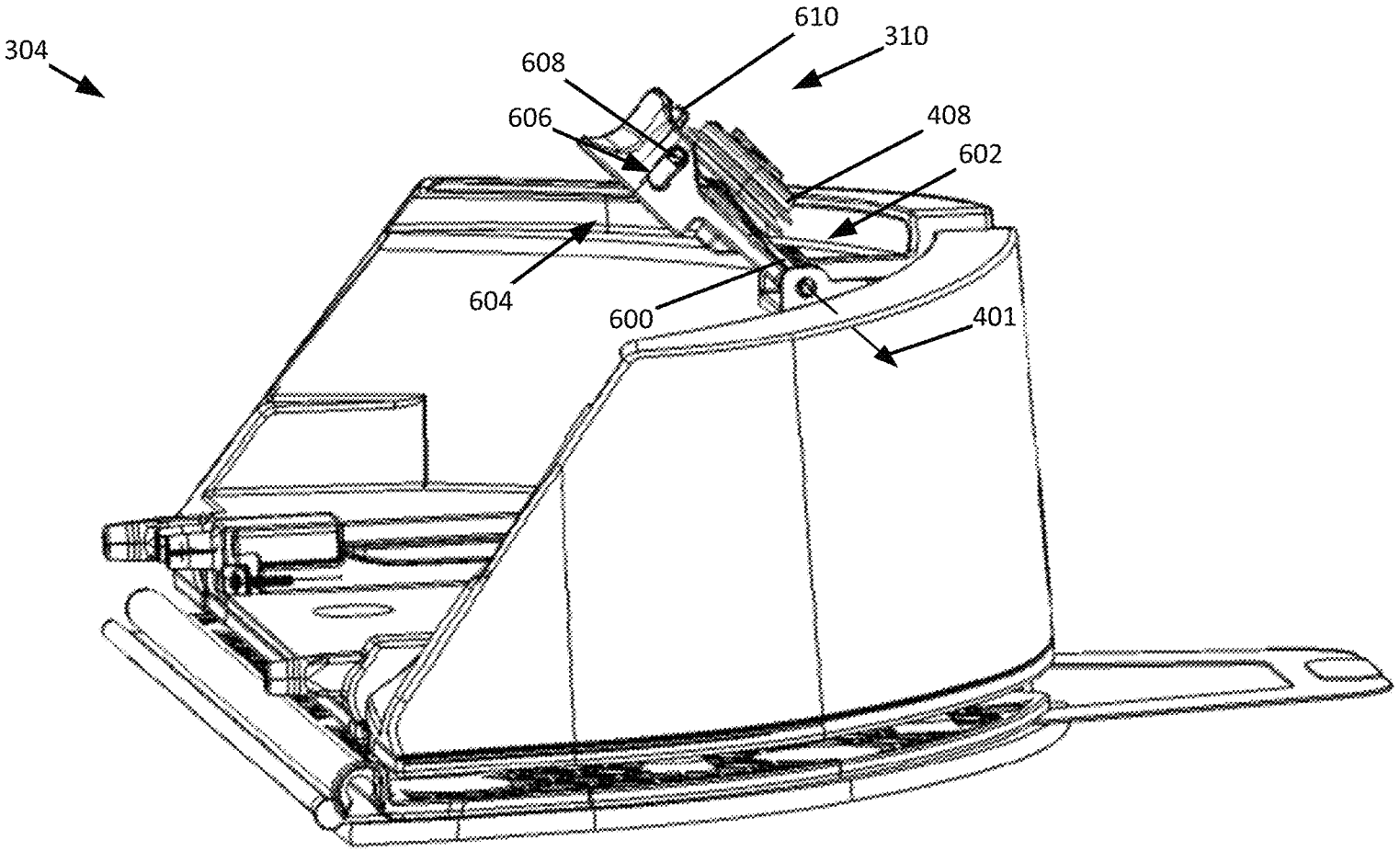
FIG. 7 shows a perspective side-view of the mop module of the robotic cleaner of FIG. 3 having the latch in the refill, position, consistent with embodiments of the present disclosure.

FIGS. 6 and 7 show perspective views of the mop module 304 decoupled from the robotic cleaner 300, wherein the latch 310 has been rotated to a refill position. As shown, when transitioning to the refill position, the latch 310 is rotated about the rotation axis 401. As the latch 310 rotates towards the refill position, the plug 408 is removed from the tank inlet 410, allowing a liquid to pass through the tank inlet 410.

As shown, the plug 408 is coupled to a plug carrier 600. The plug carrier 600 can be pivotally coupled to the lever body 400 at a first end region 602 of the lever body 400 and slidably coupled to the lever body 400 at a second end region 604 of the lever body 400, the first end region 602 being opposite the second end region 604. As such, the plug carrier 600 can slide relative to the second end region 604 of the lever body 400 in response to rotational movement of the plug carrier 600. Such a configuration may allow the plug carrier 600 to move with the lever body 400 and allow the lever body 400 to move independently from the plug carrier 600 based on a position to which the latch 310 is being transitioned towards.

The plug carrier 600 can be configured to move (e.g., rotate) with the lever body 400 when the latch 310 transitions between the latched position and the refill position. For example, the plug carrier 600 can be coupled to the lever body 400 such that the plug carrier 600 rotates about the rotation axis 401. The lever body 400 can be configured to move (e.g., rotate) independent from the plug carrier 600, when the latch 310 transitions between the latched position and the release position. For example, the lever body 400 can be configured such that the lever body 400 rotates relative to the plug carrier 600. In this example, the lever body 400 can include a carrier slot 606 within which a plug carrier connector 608 of the plug carrier 600 extends. The carrier slot 606 can be configured such that when the latch 310 transitions between the latched position and the release position, the plug carrier connector 608 slides within the carrier slot 606. In some instances, the carrier slot 606 may have an arcuate shape that generally corresponds to the rotational arc of the lever body 400 relative to the plug carrier 600.

As shown, the plug carrier 600 includes a latch retainer 610 configured to engage a tank retainer 612 of the tank 306. The latch retainer 610 can be positioned proximate the second end region 604 of the lever body 400 (e.g., between at least a portion of the plug carrier connector 608 and a distal most portion of the second end region 604) and the tank retainer 612 can be positioned proximate the tank inlet 410. The latch retainer 610 and the tank retainer 612 are configured to cooperate to prevent the latch 310 from inadvertently transitioning to the refill position when the mop module 304 is decoupled from the robotic cleaner 300. For example, the latch retainer 610 and the tank retainer 612 may form a reversible snap fit connection when the latch 310 is in the latched position and the release position. A reversible snap fit connection may generally refer to a snap fit connection capable of being repeatably coupled and uncoupled. As shown, a groove 614 may extend from the tank retainer 612 for a predetermined distance. The groove 614 may have a width that generally corresponds to a width of the tank retainer 612.

Figure 8:
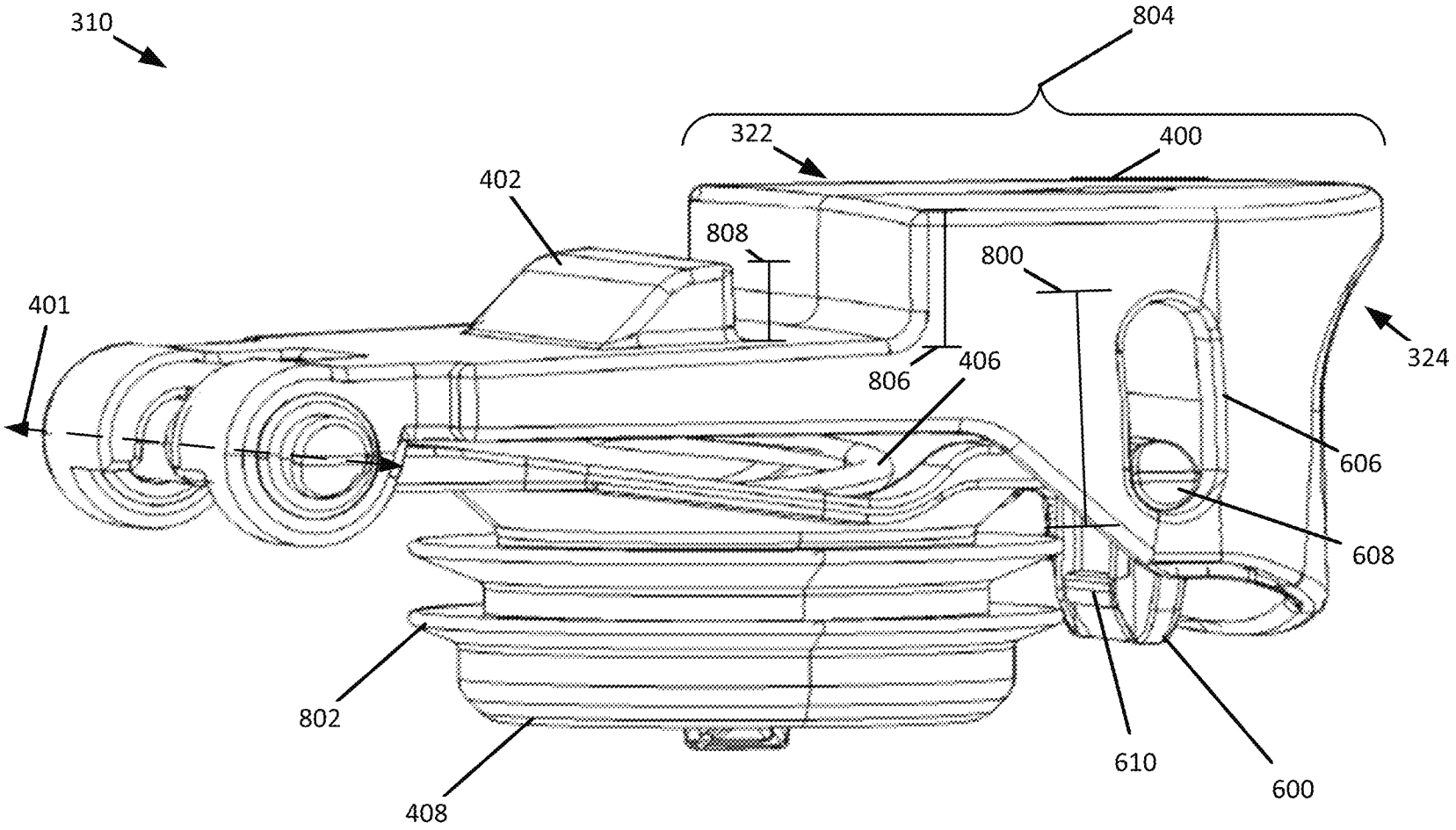
FIG. 8 shows a perspective view of the latch of the robotic cleaner of FIG. 3, consistent with embodiments of the present disclosure.

FIG. 8 shows a perspective view of the latch 310 decoupled from the mop module 304. The biasing mechanism 406 is disposed between the lever body 400 and the plug carrier 600 such that the biasing mechanism 406 urges the plug carrier 600 to rotate about the rotation axis 401 in a direction away from the lever body 400. As shown, biased movement of the plug carrier 600 relative to the lever body 400 is constrained by the carrier slot 606 and the plug carrier connector 608. The biasing mechanism 406 may be a compression spring, wherein a spring constant of the compression spring is such that, when the latch retainer 610 forms a reversible snap fit connection with the tank retainer 612 (see, FIG. 6), there is insubstantial movement (e.g., less than 1%, 2%, 3%, 4%, 5%, or 10% of total movement) between the lever body 400 and the plug carrier 600. An example compression spring may have a wire diameter of about 0.6 mm, 7 coils, an outside diameter of about 9.5 mm, a free length of about 16 mm, an installed length of about 10 mm, and a compressed length of about 7.5 mm.

The biasing mechanism 406 (e.g., when the biasing mechanism is a compression spring) may be configured to be compressed by a compression distance in a range of, for example, 1 mm to 4 mm. By way of further example the biasing mechanism 406 (e.g., when the biasing mechanism is a compression spring) may be configured to be compressed by a compression distance of about 2.8 mm.

The carrier slot 606 has a slot length 800. The slot length 800 is configured to allow the lever body 400 to rotate a sufficient distance to enable the catch 402 to move out of engagement with the protrusion 404 (see, FIG. 4) of the cleaner body 302 of the robotic cleaner 300. For example, the slot length 800 may be configured such that the catch 402 moves through a vertical distance in a range of 1 millimeter (mm) to 15 mm and/or the first user interaction surface 322 moves through a vertical distance in a range of 1 mm to 25 mm. By way of further example, the slot length 800 may be configured such that the catch 402 moves through a vertical distance of about (e.g., within 1%, 2%, 3%, 4%, or 5% of) 2 mm and/or the first user interaction surface 322 moves through a vertical distance of about 5 mm.

As shown, the plug 408 includes one or more ribs 802. The one or more ribs 802 are configured to engage with the inlet sidewall 412 (see, FIG. 4). For example, the one or more ribs 802 may be configured to form a substantially liquid tight seal with the inlet sidewall 412. The one or more ribs 802 may be configured to deform when received within the tank inlet 410 (see, FIG. 4). The one or more ribs 802 may be flared in a direction of the lever body 400 such that a width of the plug 408 increases as the plug 408 approaches the lever body 400. Such a configuration may encourage insertion of the plug 408 into the tank inlet 410.

As also shown, the lever body 400 includes an interaction portion 804, wherein a top surface of the interaction portion 804 includes the first user interaction surface 322 and a side surface of the interaction portion 804 includes the second user interaction surface 324. As shown, the first user interaction surface 322 and the second user interaction surface 324 are defined by intersecting sides of the interaction portion 804. The catch 402 is positioned between the interaction portion 804 and the rotation axis 401. The interaction portion 804 may have an interaction portion height 806 that is greater than a catch height 808 of the catch 402.

Figure 9:
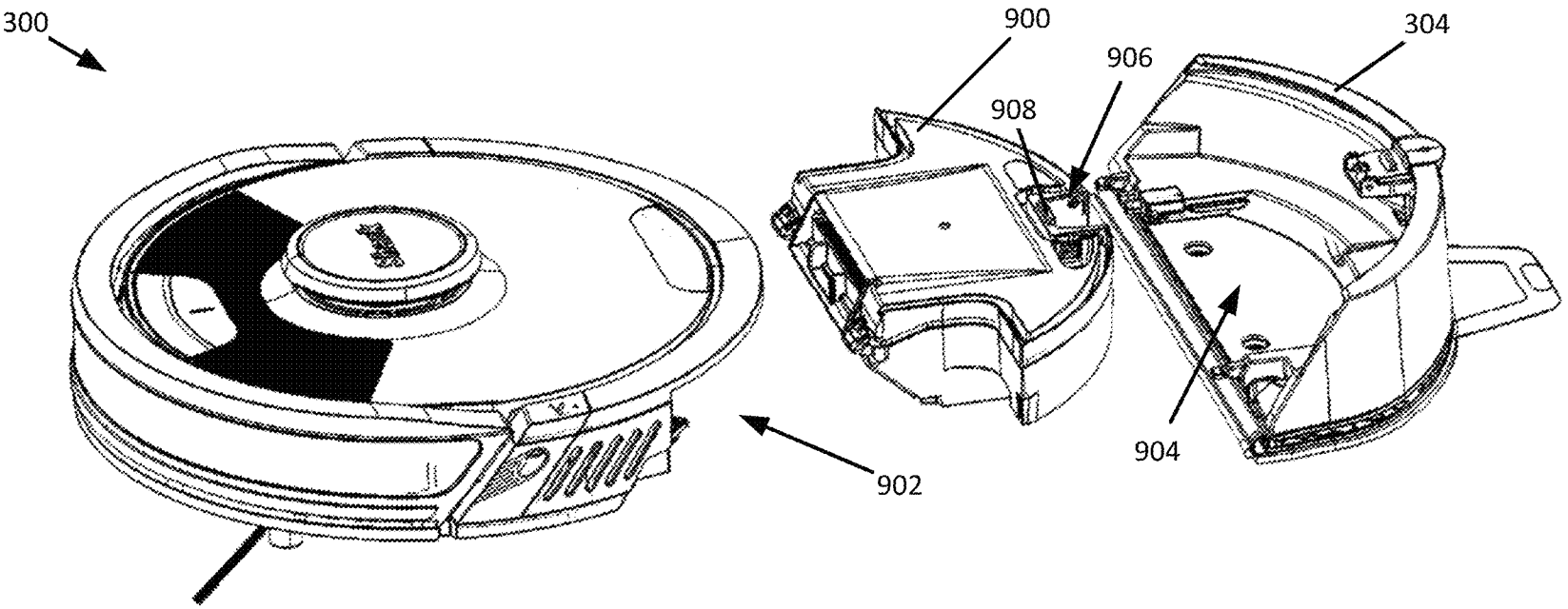
FIG. 9 shows a partial exploded view of the robotic cleaner of FIG. 3, consistent with embodiments of the present disclosure.

FIG. 9 shows a partial exploded view of the robotic cleaner 300 having a dust cup 900 and the mop module 304 removed therefrom. The dust cup 900 is configured to be received within a dust cup receptacle 902 of the robotic cleaner 300 and the mop module 304 is configured to extend around at least a portion of the dust cup 900 when coupled to the robotic cleaner 300. As shown, the mop module 304 includes a dust cup region 904 configured to extend around at least a portion of the dust cup 900 and the dust cup 900 includes a mop module cutout 906 configured to receive at least a portion of the mop module 304. The mop module cutout 906 may be configured to receive at least a portion of the tank 306. For example, the mop module cutout 906 may be configured to receive the portion of the tank 306 to which the latch 310 is coupled. The mop module cutout 906 may further include a dust cup release 908. The dust cup release 908 is configured to removably couple the dust cup 900 to the robotic cleaner 300.

Figure 10:
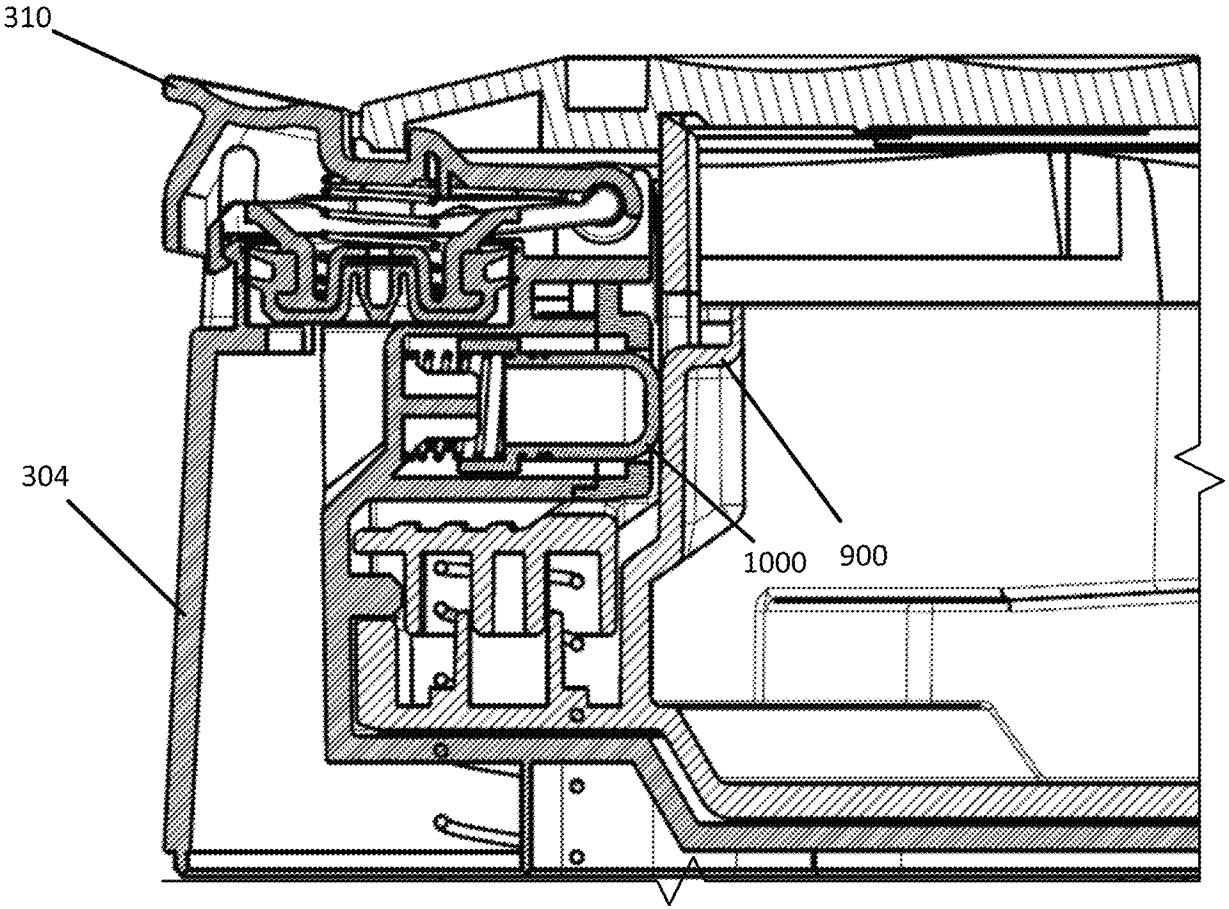
FIG. 10 shows a cross-sectional view of an example of the mop module of the robotic cleaner of FIG. 3 that includes a biased plunger in a retracted position, consistent with embodiments of the present disclosure.
Figure 11:
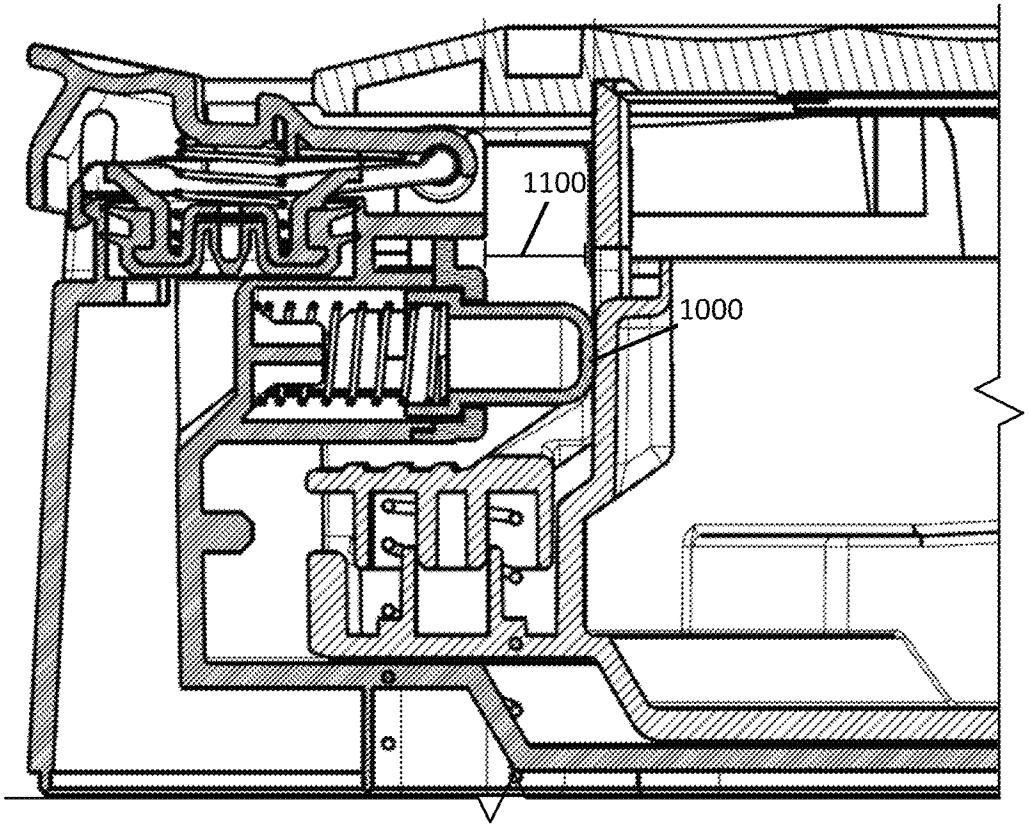
FIG. 11 shows a cross-sectional view of the example of the mop module of FIG. 3, wherein the biased plunger is in an extended position, consistent with embodiments of the present disclosure.

In some instances (e.g., as shown in FIG. 10), the mop module 304 may include a biased plunger 1000 configured to urge the mop module 304 in a direction away from the dust cup 900. For example, the biased plunger 1000 may be configured to be urged into contact with the dust cup 900 when the mop module 304 is coupled to the robotic cleaner 300. As such, when the latch 310 is transitioned to the release position, the biasing force exerted by the plunger 1000 may urge the mop module 304 away from the dust cup 900, making removal of the mop module 304 from the robotic cleaner 300 easier. The biased plunger 1000 may be configured to extend from the mop module 304 by an extension distance 1100 (see, FIG. 11). The extension distance 1100 of the biased plunger 1000 may be in a range of, for example, 7 mm to 12 mm. By way of further example, the extension distance 1100 may be about 9.5 mm. By way of still further example, the extension distance 1100 may be about 9.9 mm. The biased plunger 1000 may be biased using a compression spring. An example compression spring may have a wire diameter of about 0.6 mm, 8 coils, an outside diameter of about 8.5 mm, a free length of about 25 mm, an installed length of about 19.5 mm, and a compressed length of about 9.8 mm.

An example of a robotic cleaner, consistent with the present disclosure, may include one or more driven wheels, at least one environmental sensor, and a mop module. The mop module may include a tank having a tank inlet and a tank outlet, a pad coupled at a bottom side of the tank, the pad configured to contact a surface to be cleaned and to receive liquid from the tank outlet, and a latch configured to transition between a latched position, a release position, and a refill position. When in the latched position and in the release position, at least a portion of the latch may extend over the tank inlet and, when in the refill position, the latch may be displaced from the tank inlet, exposing the tank inlet.

In some instances, the latch may be pivotally coupled to the tank. In some instances, the latch may include a plug, the plug being configured to be received within the tank inlet when the latch is in the latched position and the release position and removed from the tank inlet when the latch is in the refill position. In some instances, the latch may include a lever body, a plug carrier, and a plug coupled to the plug carrier. In some instances, the lever body may be pivotally coupled to the tank such that, when the latch transitions between the latched position, the release position, and the refill position, the lever body rotates about a rotation axis. In some instances, the plug carrier may be coupled to the lever body such that the plug carrier rotates about the rotation axis with the lever body when the latch is transitioned to the refill position and such that the lever body rotates independently of the plug carrier when the latch transitions between the latched position and the release position. In some instances, the tank may include a tank retainer and the plug carrier includes a latch retainer, the tank retainer and the latch retainer configured to form a reversible snap fit connection when the latch is in the latched position and the release position. In some instances, the latch may further include a spring disposed between the lever body and the plug carrier. In some instances, the spring may be a compression spring that is configured such that there is insubstantial movement between the lever body and the plug carrier when the reversible snap fit connection is formed.

An example of a mop module, consistent with the present disclosure, may include a tank having a tank inlet and a tank outlet, a pad coupled at a bottom side of the tank, the pad configured to contact a surface to be cleaned and to receive liquid from the tank outlet, and a latch configured to transition between a latched position, a release position, and a refill position. When in the latched position and in the release position, at least a portion of the latch may extend over the tank inlet and, when in the refill position, the latch may be displaced from the tank inlet, exposing the tank inlet.

In some instances, the latch may be pivotally coupled to the tank. In some instances, the latch may include a plug, the plug being configured to be received within the tank inlet when the latch is in the latched position and the release position and removed from the tank inlet when the latch is in the refill position. In some instances, the latch may include a lever body, a plug carrier, and a plug coupled to the plug carrier. In some instances, the lever body may be pivotally coupled to the tank such that, when the latch transitions between the latched position, the release position, and the refill position, the lever body rotates about a rotation axis. In some instances, the plug carrier may be coupled to the lever body such that the plug carrier rotates about the rotation axis with the lever body when the latch is transitioned to the refill position and such that the lever body rotates independently of the plug carrier when the latch transitions between the latched position and the release position. In some instances, the tank may include a tank retainer and the plug carrier includes a latch retainer, the tank retainer and the latch retainer configured to form a reversible snap fit connection when the latch is in the latched position and the release position. In some instances, the latch may further include a spring disposed between the lever body and the plug carrier. In some instances, the spring may be a compression spring that is configured such that there is insubstantial movement between the lever body and the plug carrier when the reversible snap fit connection is formed.

An example of a latch, consistent with the present disclosure, may include a lever body, the lever body including a catch, a first end region, and a second end region, a plug carrier pivotally coupled to the lever body at the first end region and slidably coupled to the lever body at the second end region, wherein the plug carrier slides relative to the second end region of the lever body in response to rotational movement of the plug carrier, a plug coupled to the plug carrier, the plug and the catch being on opposite sides of the lever body, and a biasing mechanism disposed between the plug carrier and the lever body.

In some instances, the lever body may include a slot and the plug carrier may include a plug carrier connector configured to slide within the slot, biased movement of the plug carrier being constrained by the slot.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

one or more driven wheels;

at least one environmental sensor; and a mop module, the mop module including:

a tank having a tank inlet and a tank outlet;

a pad coupled at a bottom side of the tank, the pad configured to contact a surface to be cleaned and to receive liquid from the tank outlet; and a latch configured to removably couple the mop module to the robotic cleaner and to selectively cover the tank inlet, the latch configured to transition between a latched position, a release position, and a refill position, when in the latched position and in the release position, at least a portion of the latch extends over the tank inlet;

when in the refill position, the latch is displaced from the tank inlet, exposing the tank inlet;

when in the latched position, separation of the mop module from the robotic cleaner is prevented; and when in the release position, the mop module is separable from the robotic cleaner.

2. The robotic cleaner of claim 1, wherein the latch is pivotally coupled to the tank.

3. The robotic cleaner of claim 1, wherein the latch includes a plug, the plug being configured to be received within the tank inlet when the latch is in the latched position and the release position and removed from the tank inlet when the latch is in the refill position.

4. The robotic cleaner of claim 1, wherein the latch includes a lever body, a plug carrier, and a plug coupled to the plug carrier.

5. The robotic cleaner of claim 4, wherein the lever body is pivotally coupled to the tank such that, when the latch transitions between the latched position, the release position, and the refill position, the lever body rotates about a rotation axis.

6. The robotic cleaner of claim 5, wherein the plug carrier is coupled to the lever body such that the plug carrier rotates about the rotation axis with the lever body when the latch is transitioned to the refill position and such that the lever body rotates independently of the plug carrier when the latch transitions between the latched position and the release position.

7. The robotic cleaner of claim 4, wherein the tank includes a tank retainer and the plug carrier includes a latch retainer, the tank retainer and the latch retainer configured to form a reversible snap fit connection when the latch is in the latched position and the release position.

8. The robotic cleaner of claim 7, wherein the latch further includes a spring disposed between the lever body and the plug carrier.

9. The robotic cleaner of claim 8, wherein the spring is a compression spring that is configured such that there is insubstantial movement between the lever body and the plug carrier when the reversible snap fit connection is formed.

10. The robotic cleaner of claim 9, wherein the compression spring is configured to be compressed by a compression distance in a range of 1 millimeter (mm) to 4 mm.

11. A mop module comprising:

a tank having a tank inlet and a tank outlet;

a pad coupled at a bottom side of the tank, the pad configured to contact a surface to be cleaned and to receive liquid from the tank outlet; and a latch configured to transition between a latched position, a release position, and a refill position, the latch including a lever body, a plug carrier, and a plug coupled to the plug carrier, when in the latched position and in the release position, at least a portion of the latch extends over the tank inlet; and when in the refill position, the latch is displaced from the tank inlet, exposing the tank inlet.

12. The mop module of claim 11, wherein the latch is pivotally coupled to the tank.

13. The mop module of claim 11, wherein the plug is configured to be received within the tank inlet when the latch is in the latched position and the release position and removed from the tank inlet when the latch is in the refill position.

14. The mop module of claim 11, wherein the lever body is pivotally coupled to the tank such that, when the latch transitions between the latched position, the release position, and the refill position, the lever body rotates about a rotation axis.

15. The mop module of claim 14, wherein the plug carrier is coupled to the lever body such that the plug carrier rotates about the rotation axis with the lever body when the latch is transitioned to the refill position and such that the lever body rotates independently of the plug carrier when the latch transitions between the latched position and the release position.

16. The mop module of claim 11, wherein the tank includes a tank retainer and the plug carrier includes a latch retainer, the tank retainer and the latch retainer configured to form a reversible snap fit connection when the latch is in the latched position and the release position.

17. The mop module of claim 16, wherein the latch further includes a spring disposed between the lever body and the plug carrier.

18. The mop module of claim 17, wherein the spring is a compression spring that is configured such that there is insubstantial movement between the lever body and the plug carrier when the reversible snap fit connection is formed.

19. The mop module of claim 18, wherein the compression spring is configured to be compressed by a compression distance in a range of 1 millimeter (mm) to 4 mm.

* * * * *